US006328595B1

(12) United States Patent
Chang

(10) Patent No.: US 6,328,595 B1
(45) Date of Patent: Dec. 11, 2001

(54) ELECTRIC CONNECTOR

(75) Inventor: Chih-Kai Chang, Sanchung (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 09/842,724

(22) Filed: Apr. 27, 2001

(51) Int. Cl.[7] ..... H01R 3/00
(52) U.S. Cl. ..... 439/490; 439/620; 439/676
(58) Field of Search ..... 439/488–490, 439/638, 639, 676, 620, 701, 344

(56) References Cited

U.S. PATENT DOCUMENTS 5,704,802 * 1/1998 Loudermilk ..... 439/490
6,102,741 * 8/2000 Boutros et al. ..... 439/620
6,132,260 * 10/2000 Wu ..... 439/676
6,234,847 * 5/2001 Chang ..... 439/676

* cited by examiner

*Primary Examiner*—Brian Sircus
*Assistant Examiner*—Son V. Nguyen
(74) *Attorney, Agent, or Firm*—Bacon & Thomas, PLLC

(57) ABSTRACT

An electric connector includes an electric circuit assembly unit mounted in an electrically insulative housing, and a metal shield covered on the electrically insulative housing, the electric circuit assembly including a terminal holder mounted in the electrically insulative housing, and a circuit board supported on the terminal holder, the terminal holder having a base, which supports the circuit board, a front extension board and a rear extension board respectively extended from front and rear sides of the base in reversed directions, the rear extension board having a plurality of terminal slots and an upright support adapted to support the circuit board on the base, and a plurality of terminals respectively mounted in the front extension board and base of the terminal holder and electrically connected to the circuit board, the circuit board having a plurality of terminals respectively inserted through respective terminal slots of the terminal holder for connection to an external circuit board.

7 Claims, 7 Drawing Sheets

ELECTRIC CONNECTOR

BACKGROUND OF THE INVENTION

The present invention relates to electric connectors, and more specifically, to such an electric connector, in which the circuit board is horizontally supported on the base and an upright support of the terminal to minimize space occupation.

Following fast development of computer technology, advanced desktop and notebook computers have been continuously developed. In consequence, a variety of electric connectors have been disclosed for use with different computers and the telephone line for connection to the Internet to obtain data. Currently, RJ45 connectors are commonly used for enabling a computer to be connected to the Internet. A RJ45 connector may be provided with indicator LEDs (light emitting diodes) for signal transmission indication. However, the operation of LEDs in a RJ45 connector produces high-frequency electric waves that interfere with operation of nearby electric/electronic apparatus. Further, external noises may interfere with the transmission of signal in conventional RJ45 connectors. In order to protect against EMI (electromagnetic interference), a computer connector is generally covered with a metal shied and installed with a filter module. A capacitor may be provided in the filter module to protect against surge. An electric connector with EMI protective circuit means is expensive. Taiwan Patent Publication No. 347153, issued to the present inventor on Dec. 1, 1998, indicates an electronic socket. This structure of electronic socket, as shown in FIGS. 7 and 8, is comprised of a terminal holder assembly formed of a front terminal holder unit B and a rear terminal holder unit D, an electrically insulative housing A, a metal shield E, terminals B1 and D1, and a vertical circuit board C. The terminal holder assembly is inserted into the electrically insulative housing A. The terminals B1 and D1 of the front terminal holder unit B and rear terminal unit D of the terminal holder assembly are respectively soldered to the vertical circuit board C. The vertical circuit board C comprises a filter module C1. This design effectively eliminates the interference of external electromagnetic waves. However, because the circuit board is installed in vertical, much vertical installation space is required, and therefore the vertical size of this design of electric socket cannot be minimized to fit thin-size notebook computers.

SUMMARY OF THE INVENTION

The present invention has been accomplished to provide an electric connector, which eliminates the aforesaid drawbacks. It is the main object of the present invention to provide an electric connector, which requires less vertical installation space. It is another object of the present invention to provide an electric connector, which is easy to assemble/disassemble. According to one aspect of the present invention, the electric connector electric connector comprises an electric circuit assembly unit mounted in an electrically insulative housing, and a metal shield covered on the electrically insulative housing, the electric circuit assembly comprising a terminal holder mounted in the electrically insulative housing, and a circuit board supported on the terminal holder, the terminal holder comprising a base, which supports the circuit board, a front extension board and a rear extension board respectively extended from front and rear sides of the base in reversed directions, the rear extension board having a plurality of terminal slots, and an upright support adapted to support the circuit board on the base, and a plurality of terminals respectively mounted in the front extension board and base of the terminal holder and electrically connected to the circuit board, the circuit board having a plurality of terminals respectively inserted through respective terminal slots of the terminal holder for connection to an external circuit board. According to another aspect of the present invention, the electrically insulative housing is comprised of an outer casing and an inner casing detachably mounted in the outer casing. According to still another aspect of the present invention, the circuit board comprises capacitor and filter module means to protect the internal circuit against external noises.

DETAILED DESCRIPTION OF THE PREFERRED EMBODIMENT

Figure 1:
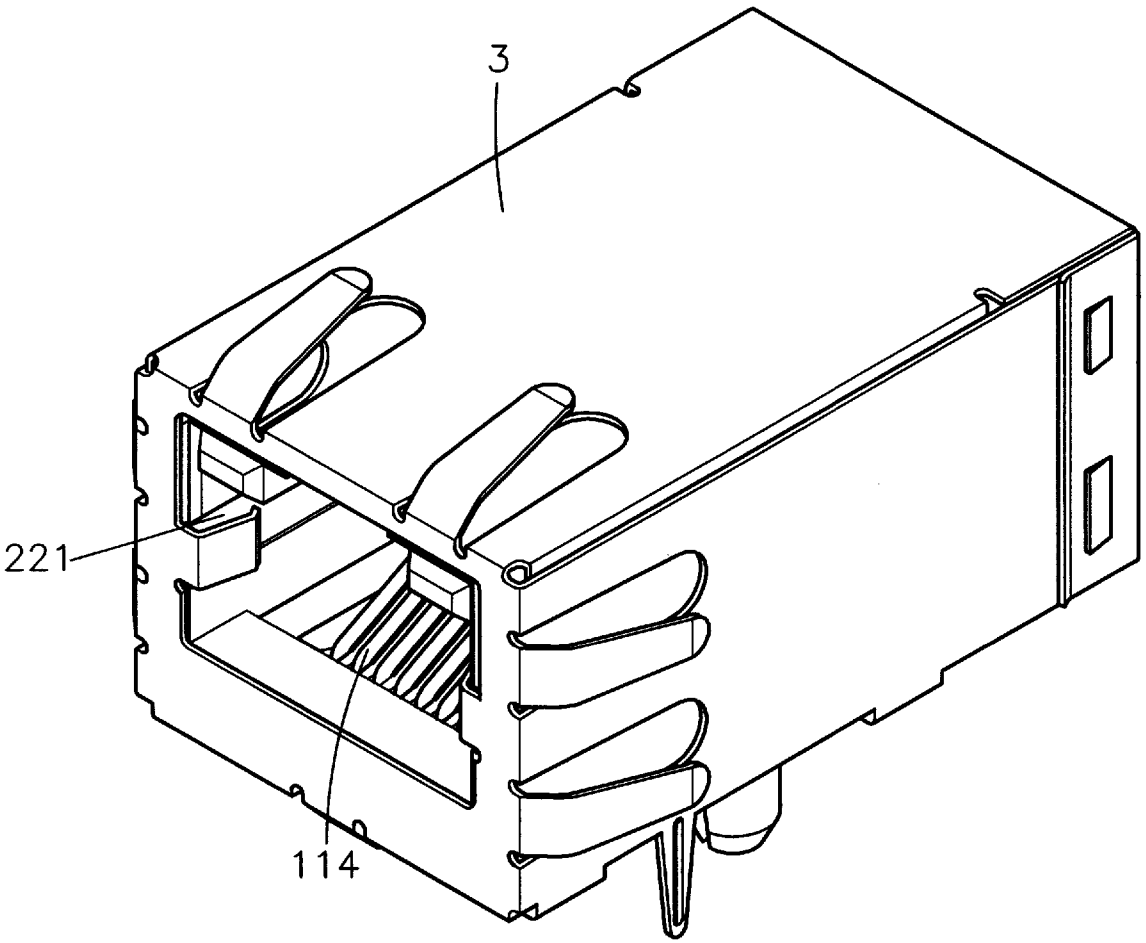
FIG. 1 is a perspective view of an electric connector according to the present invention.
Figure 2:
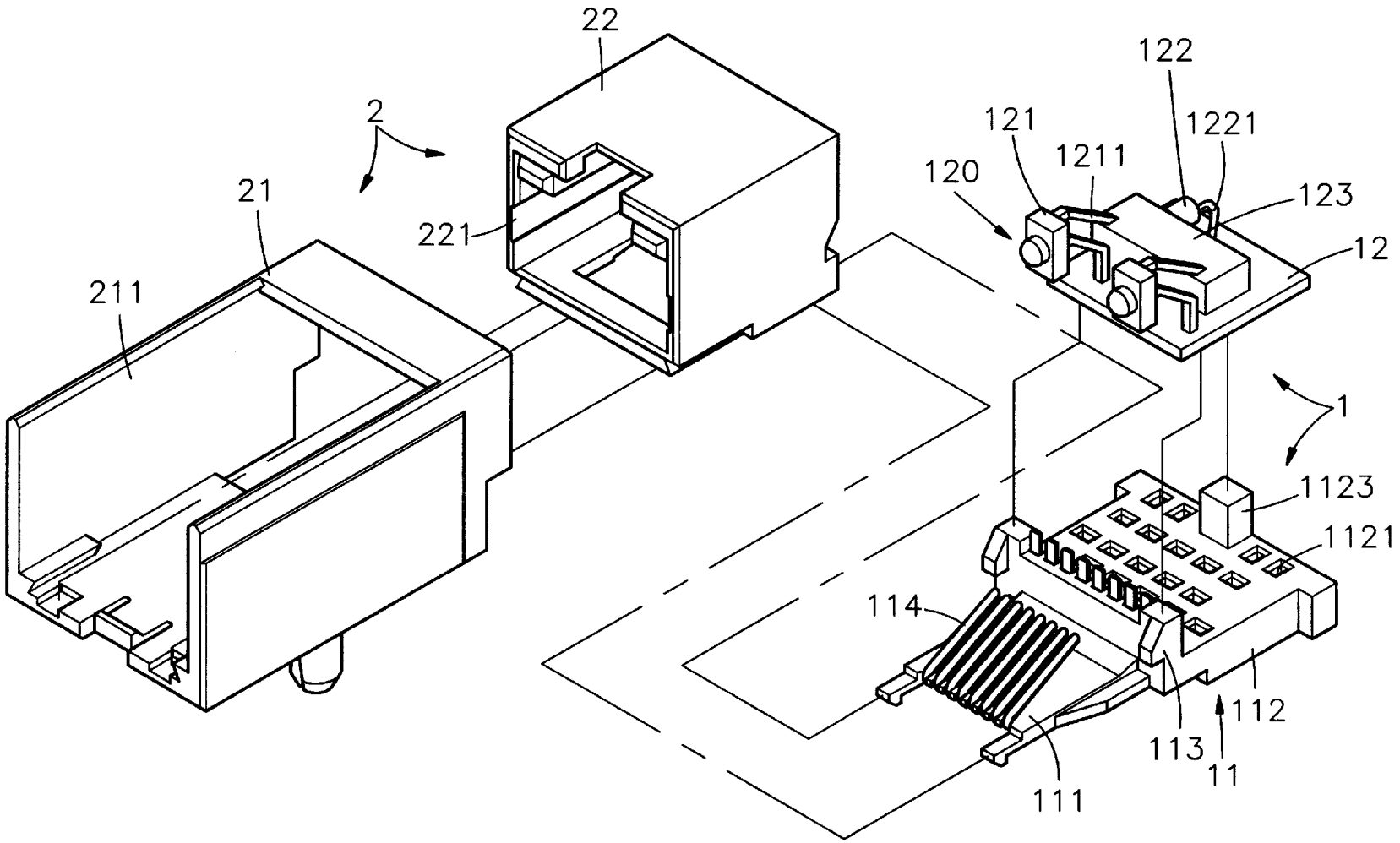
FIG. 2 is an exploded view of the electric connector according to the present invention.
Figure 3:
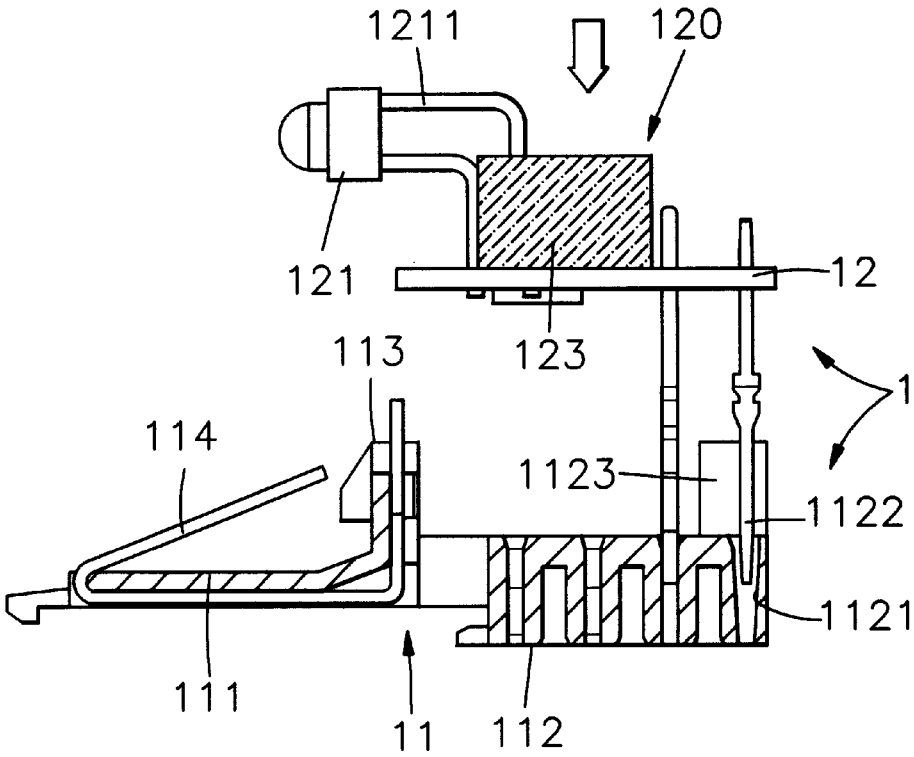
FIG. 3 is an exploded side view of the electric circuit assembly unit for the electric connector according to the present invention.

Referring to FIGS. from 1 through 3, the present invention comprises an electric circuit assembly unit 1, an electrically insulative housing 2, and a metal shield 3.

The electric circuit assembly unit 1 is comprised of a terminal holder 11 and a circuit board 12. The terminal holder 11 is a flat rectangular member comprising a base 113, a front extension board 111 forwardly extended from the base 113, a rear extension board 112 backwardly extended from the base 113, and a plurality of terminals 114 mounted in the front extension board 111 and the base 113 and arranged in parallel. The rear extension board 112 has a plurality of terminal slots 1121. The terminals 114 each have a front end protruded from the front side of the front extension board 111 and turned backwardly upwards, and a rear end backwardly extended out of the base 113 and soldered to the circuit board 12. The circuit board 12 is horizontally supported on the base 113 of the terminal holder 11 and an upright support 1123 of the rear extension board 112, comprising an electronic component part unit 120 and a plurality of terminals 1122. The electronic component part unit 120 includes light emitting diodes 121, a capacitor 122, and a filter module 123. The terminals 1122 each have one end respectively soldered to the circuit board 12 and an opposite end respectively inserted through the terminal slots 1121 of the rear extension board 112 of the terminal holder 11 for connection to a respective contact of an external circuit board (not shown). The capacitor 122 has a grounding terminal 1221 for connection to the metal shield 3. The electrically insulative housing 2 comprises an outer casing 21 and an inner casing 22. The outer casing 21 comprises a receiving chamber 211 adapted to receive the inner casing 22. The inner casing 22 fits into the outer casing 21, comprising a receiving chamber 221 adapted to receive a matching electric connector. After insertion of the inner casing 22 into the rear end of the outer casing 21, a gap is defined between the bottom sidewall of the outer casing 21 and the bottom sidewall of the inner casing 22 for receiving the front extension board 111 of the terminal holder 11 of the electric circuit assembly unit 1. The metal shield 3 is covered on the electrically insulative housing 2 for EMI (electromagnetic interference) protection.

Figure 4:
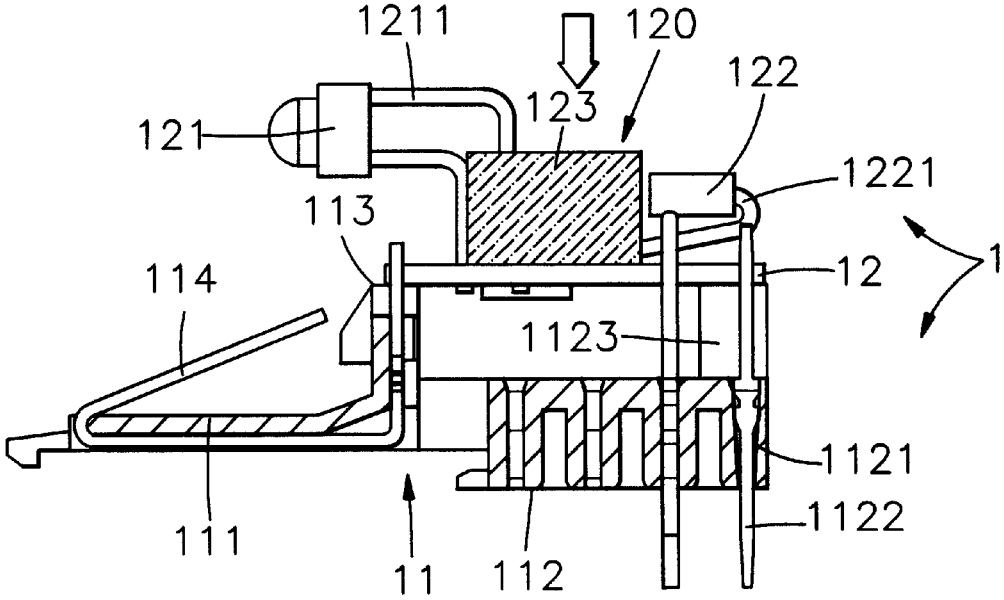
FIG. 4 is an assembly view of FIG. 3.
Figure 5:
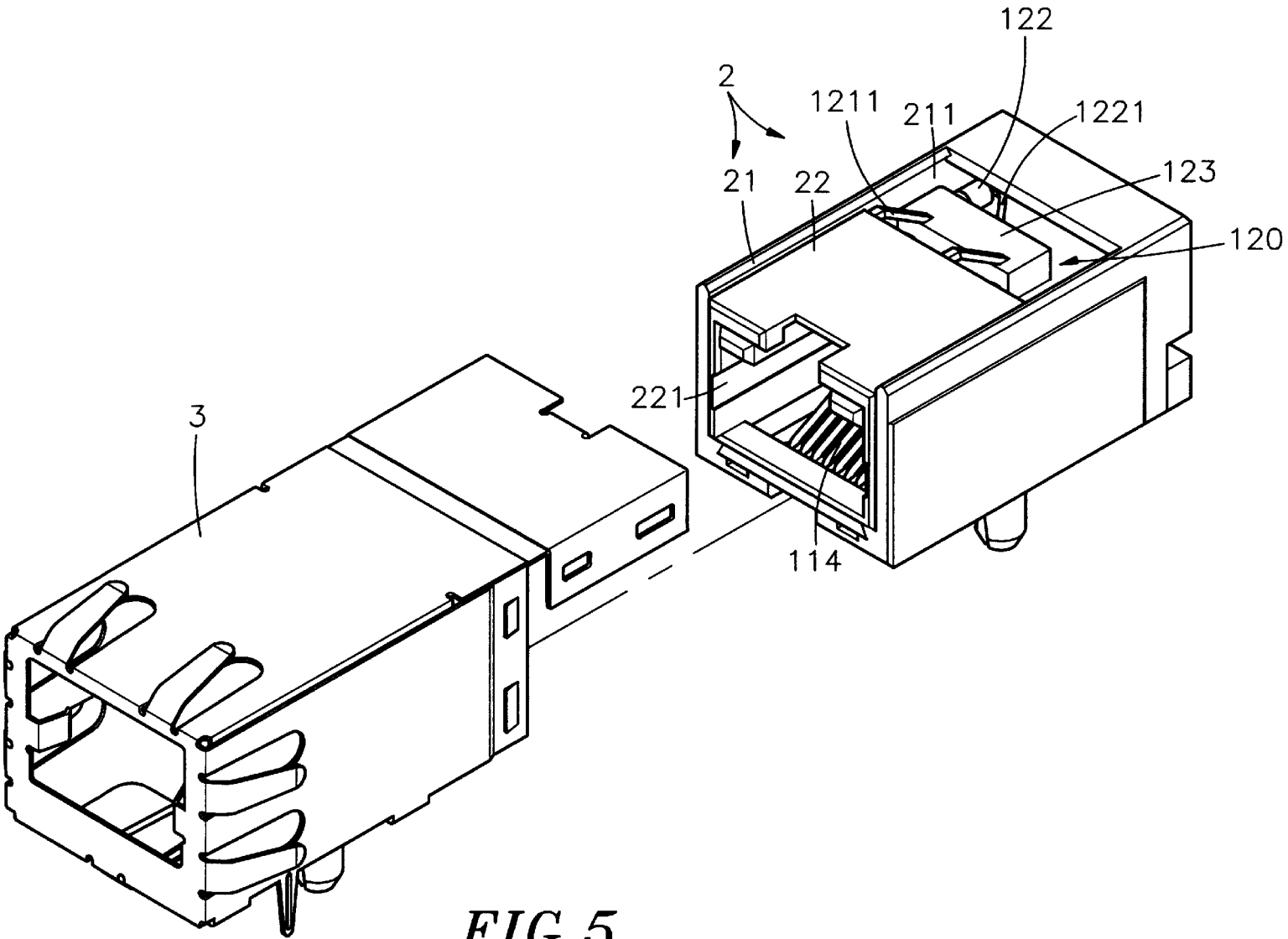
FIG. 5 is an exploded view of the metal shield and the electrically insulative housing, showing the electric circuit assembly unit installed in the electrically insulative housing.
Figure 6:
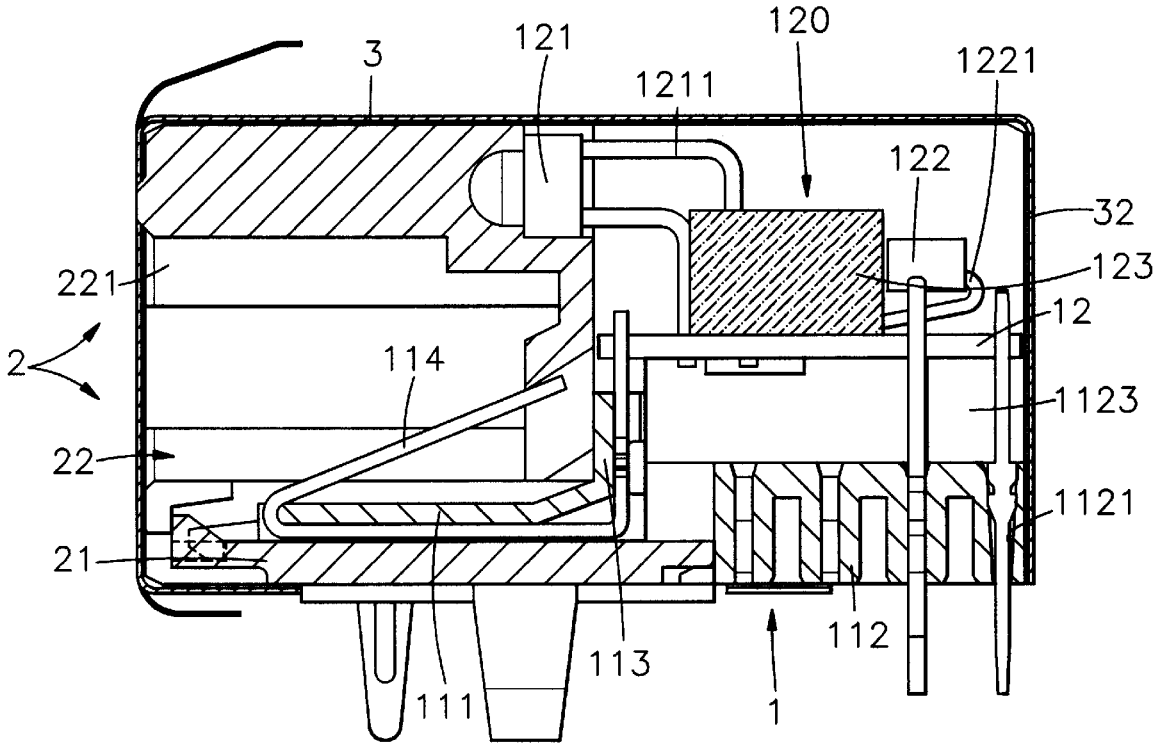
FIG. 6 is a side view in section of the electric connector according to the present invention.
Figure 7:
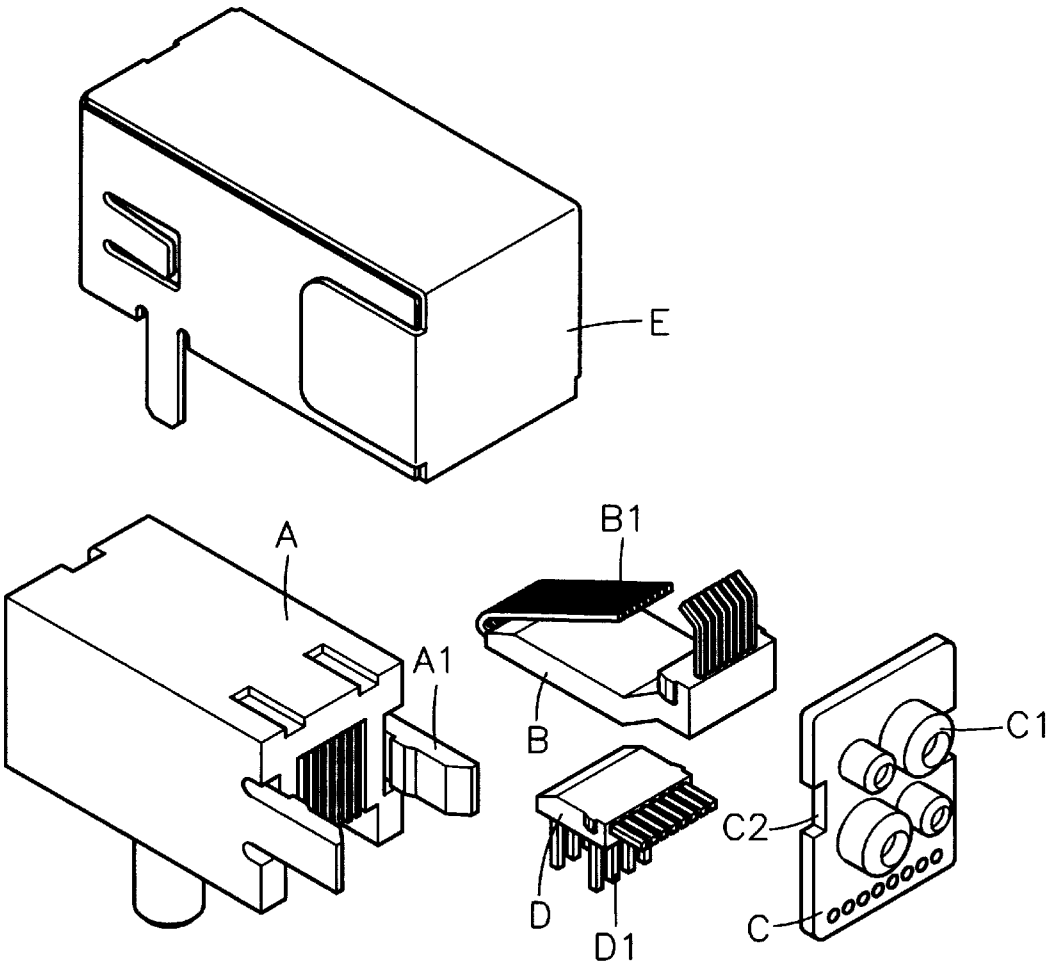
PRIOR ART FIG. 7
FIG. 7 is an exploded view of the prior art design.
Figure 8:
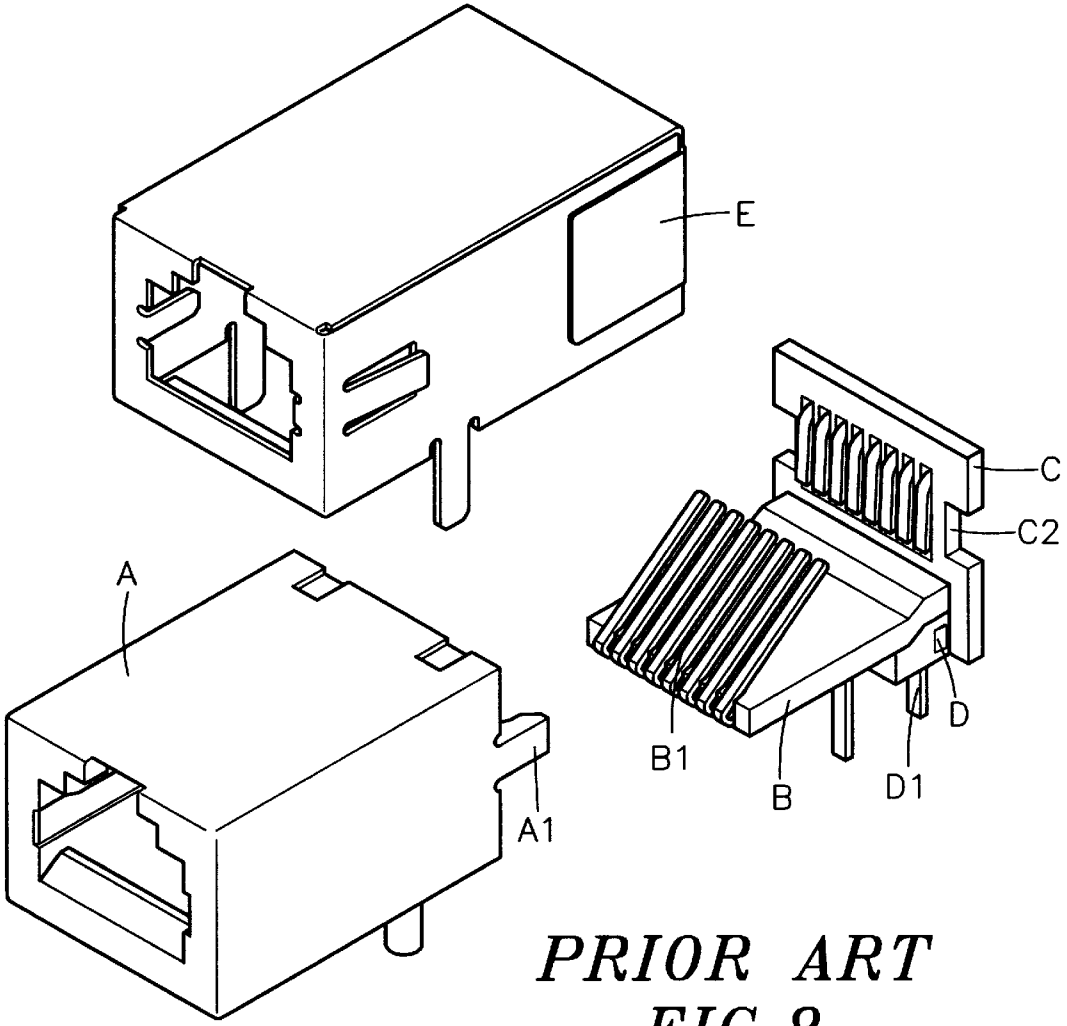
PRIOR ART FIG. 8
FIG. 8 is another exploded view of the prior art design showing the terminal holders and the circuit board assembled.

The assembly process of the present invention is outlined hereinafter with reference to FIGS. from 2 through 6. The light emitting diodes 121, the capacitor 122, and the filter module 123 are soldered to the respective contacts at the top side of the circuit board 12, and then the terminals 1122 are respectively soldered to the respective contacts (not shown) at the bottom side of circuit board 12, and then the circuit board 12 is supported on the base 113 and upright support 1123 of the terminal holder 11 for enabling the terminals 1122 to be respectively inserted through the terminal slots 1121 of the rear extension board 112 of the terminal holder 11 and soldered to the respective contacts of the external circuit board (not shown), and then the tail of each of terminals 114 of the terminal holder 11 is respectively soldered to the circuit board 12 (see FIG. 4), and then the inner casing 22 is inserted into the outer casing 21 from the rear side of the outer casing 21, and then the front extension board 111 of the terminal holder 11 is inserted into the gap between the bottom sidewall of the inner casing 22 and the bottom sidewall of the outer casing 21, and then the metal shield 3 is covered on the electrically insulative housing 2 (see FIGS. 1 and 6). When assembled, the terminals 114 of the terminal holder 11 are suspended in the receiving chamber 221 of the inner casing 22 of the electrically insulative housing 2 for the contact of the respective terminals of the matching electric connector (not shown).

As indicated above, the electronic component part unit 120 comprises two light emitting diodes 121. The lead-out wires 1211 of the light emitting diodes 121 are respectively connected to the circuit board 12. During signal transmission through the electric connector, the light emitting diodes 121 are turned on to emit light toward the front side of the electric connector, indicating the operation status of the electric connector.

A prototype of electric connector has been constructed with the features of FIGS. 1~6. The electric connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electric connector comprising an electrically insulative housing, an electric circuit assembly unit installed in said electrically insulative housing, and a metal shield covered on said electrically insulative housing, wherein:

said electrically insulative housing comprising a receiving chamber adapted to receive a matching electric connector;

said electric circuit assembly unit comprises a terminal holder mounted in said electrically insulative housing, and a circuit board horizontally supported on said terminal holder, said terminal holder comprising a base adapted to support said circuit board, a front extension board and a rear extension board respectively extended from front and rear sides of said base in reversed directions, said rear extension board comprising a plurality of terminal slots, and a plurality of terminals respectively mounted in the front extension board and base of said terminal holder and electrically connected to said circuit board, said circuit board comprising a plurality of terminals respectively inserted through the terminal slots of said terminal holder for connection to an external circuit board and an electronic component part unit.

2. The electric connector grounding structure of claim 1 wherein said electrically insulative housing is comprised of an outer casing and an inner casing mounted in said outer casing.

3. The electric connector grounding structure of claim 1 wherein said electronic component part unit includes a capacitor.

4. The electric connector grounding structure of claim 1 wherein said electronic component part unit includes a filter module.

5. The electronic connector grounding structure of claim 1 wherein said electronic component part unit includes at least one light emitting diode adapted to emit light toward a front side of said electrically insulative housing.

6. The electronic connector grounding structure of claim 1 wherein the terminals of said terminal holder each having a tail respectively soldered to said circuit board and a front end extended out of a front side of said front extension board and turned backwardly upwards and suspending in said receiving chamber of said electrically insulative housing.

7. The electronic connector grounding structure of claim 1 wherein said rear extension board of said terminal holder comprises an upright support adapted to support said circuit board on the base of said terminal holder.

* * * * *